US007475531B2

(12) United States Patent
Artzt et al.

(10) Patent No.: US 7,475,531 B2
(45) Date of Patent: Jan. 13, 2009

(54) DRAWING FRAME WITH APRONS ENTWINED AROUND TWIN OUTPUT TOP DELIVERY ROLLERS

(75) Inventors: Peter Artzt, Reutlingen (DE); Theo Grün, Esslingen (DE); Larisa Ausheyks, Aichwald (DE); Stefan Krawietz, Ebersbach/Fils (DE)

(73) Assignee: Institut fur Textil-und Verfahrenstechnik Denkendorf der deutschen Institute fur Textil-und Faserforschung, Denkendorf (DE)

( * ) Notice: Subject to any disclaimer, the term of this patent is extended or adjusted under 35 U.S.C. 154(b) by 69 days.

(21) Appl. No.: 10/575,372

(22) PCT Filed: Oct. 14, 2004

(86) PCT No.: PCT/EP2004/011522

§ 371 (c)(1),
(2), (4) Date: Dec. 13, 2006

(87) PCT Pub. No.: WO2005/038104

PCT Pub. Date: Apr. 28, 2005

(65) Prior Publication Data

US 2007/0169459 A1 Jul. 26, 2007

(30) Foreign Application Priority Data

Oct. 17, 2003 (DE) ..... 103 48 452

(51) Int. Cl.
*D01H 5/26* (2006.01)

(52) U.S. Cl. ..... 57/315; 19/244; 19/250

(58) Field of Classification Search ..... 57/315–331; 19/244–256

See application file for complete search history.

(56) References Cited

U.S. PATENT DOCUMENTS

| | | | | | |
|---|---|---|---|---|---|
| 2,193,196 | A | * | 3/1940 | Jackson | 19/253 |
| 2,856,643 | A | * | 10/1958 | Spencer | 19/244 |
| 2,943,361 | A | * | 7/1960 | Cotchett | 19/251 |
| 4,067,088 | A | * | 1/1978 | Wurmli | 19/253 |

(Continued)

FOREIGN PATENT DOCUMENTS

CH 360327 3/1962

(Continued)

OTHER PUBLICATIONS

German Patent Office Search Report, May 19, 2004.

(Continued)

*Primary Examiner*—Shaun R Hurley
(74) *Attorney, Agent, or Firm*—Dority & Manning, P.A.

(57) ABSTRACT

The invention relates to a drafting device with twin top front rollers surrounded by aprons in which the aprons are guided around deflection members arranged above the area facing away from the clamping surface of the front roller pair. In order to achieve a low-friction, brake-free and low-wear running of the aprons, they are guided with only a slight tension around the deflection members. For this, the tendency of the aprons to assume a circular form in the circumferential direction is utilized. This tendency brings about, with the appropriately selected interval between the top front rollers and between the surfaces of the deflection members, the low contact pressure on the surfaces striven for and the low tractive tension in the aprons striven for.

11 Claims, 2 Drawing Sheets

U.S. PATENT DOCUMENTS

| | | | | |
|---|---|---|---|---|
| 4,509,230 | A * | 4/1985 | Wuermli | 19/245 |
| 4,513,481 | A * | 4/1985 | Suzuki et al. | 19/244 |

FOREIGN PATENT DOCUMENTS

| | | |
|---|---|---|
| DE | R776C30/04V | 9/1950 |
| DE | 816069 | 10/1951 |
| DE | 10260025 | 7/2004 |
| GB | 2058850 | 4/1981 |
| SU | 701181 | 9/1981 |

OTHER PUBLICATIONS

PCT Search Report, Feb. 16, 2005.
PCT International Preliminary Examination Report, Aug. 17, 2005.

* cited by examiner

DRAWING FRAME WITH APRONS ENTWINED AROUND TWIN OUTPUT TOP DELIVERY ROLLERS

FIELD OF THE INVENTION

The invention relates to a drafting device with twin top delivery rollers in which the aprons are guided around deflection members arranged on the area facing away from the clamping surface of the front roller pair.

BACKGROUND OF THE INVENTION

When drafting slivers in drafting devices, the clamping action of the roller pairs plays a decisive part for the transmission of the drafting forces onto the fiber bundle. The roller pairs of a drafting device therefore consist of a lower, channeled steel roller, the so-called bottom roller, and of an upper roller, the so-called top roller, that is pressed by a loading apparatus onto the bottom roller. This top roller generally has an elastic coating so that no clamping line is produced but rather a clamping surface by the deformation of the elastic coating, which surface brings about a distinctly better retention of the fibers. A good clamping action is exerted on the fiber bundle without damaging the fibers. Experience has shown that soft roller coatings therefore yield better drafting results since the softer the coating is, the larger the clamping action is. However, the soft roller coatings have the disadvantage that they wear very rapidly and must be reground. This changes the geometry of the drafting cylinder and therewith also the properties of the coating, which for its part has a disadvantageous effect on the drafting conditions and thus on the yarn quality. Moreover, the grinding of the roller is an expensive measure.

In order to unite a high degree of softness of the roller coating with high wear resistance and thus create optimal drafting conditions for a long time of use, DE 102 60 025.2 (that is not a prior publication) suggests surrounding a top roller with a soft coating with an apron with a high wear resistance. This separate apron has the advantage that it can be readily replaced in the case of wear or damage. A replacement by an apron with a different hardness, a different method, or some other different type or quality, is readily possible.

It is obvious that this solution is advantageous, in particular on the front roller pair of a drafting device in which the rollers run especially rapidly and have the greatest influence on a reliable drafting.

The surrounding of the top front rollers of drafting devices with aprons is known (DE 816 069; DE-GM R7). The explained purpose of these rather long aprons is to prevent the formation of windings around the top rollers of the front roller pair. These aprons are associated with tensioning devices that keep them under tractive tension and thus keep them tight.

The aprons are conducted on these tensioning devices via stationary deflection members. It turned out that drive energy is consumed by the aprons being drawn over these deflection members, the aprons experience a braking that has a disadvantageous effect on the drawing process and are subject to wear.

The present invention therefore has the problem of avoiding these disadvantages.

SUMMARY

Objects and advantages of the invention are set forth in part in the following description, or may be obvious from the description, or may be learned through practice of the invention.

In order to keep the tractive tension as low as possible in the aprons, aprons are therefore used that have the tendency to assume an approximately circular form in the non-loaded state in the circumferential direction. Since the aprons generally consist of synthetic material, this tendency is a given inherent feature. The interval between the top front rollers and the bearing surfaces of the deflection members is selected in such a manner that the aprons can bulge out in the areas between top roller and deflection member due to the tendency to assume an approximately circular form in the circumferential direction. They then rest on the deflection members with only a slight pressure and accordingly are under only a slight tractive tension. They therefore experience practically no braking, consume no noticeable drive energy and are subject to practically no wear.

This effect is favored even more if the coefficient of friction between the inner running layer of the aprons and the deflection members is kept as low as possible by an appropriate pairing of material.

The low contact pressure of the aprons on the deflection members can then be achieved if the circumference of the circular form striven for corresponds approximately to 1½ to 3 times the circumference of the surrounded top rollers and if the interval between the surrounded top rollers and the deflection members corresponds to one half to twice the diameter of the surrounded top rollers.

In this instance the two deflection members of a twin top roller can be formed on a one-piece, rigid, holder fastened on a structural component connected to the twin top roller in a preferably detachable manner. The holder can comprise a holding member that can be connected to the shaft of the twin top roller or it can be fastened to the guide rod of the twin top roller or to the top roller carrying and loading arm.

Guiding surfaces are arranged for the lateral guidance of the aprons.

Two preferred non-limiting exemplary embodiments of the invention are shown in the figures of the drawings.

DESCRIPTION

Figure 1:
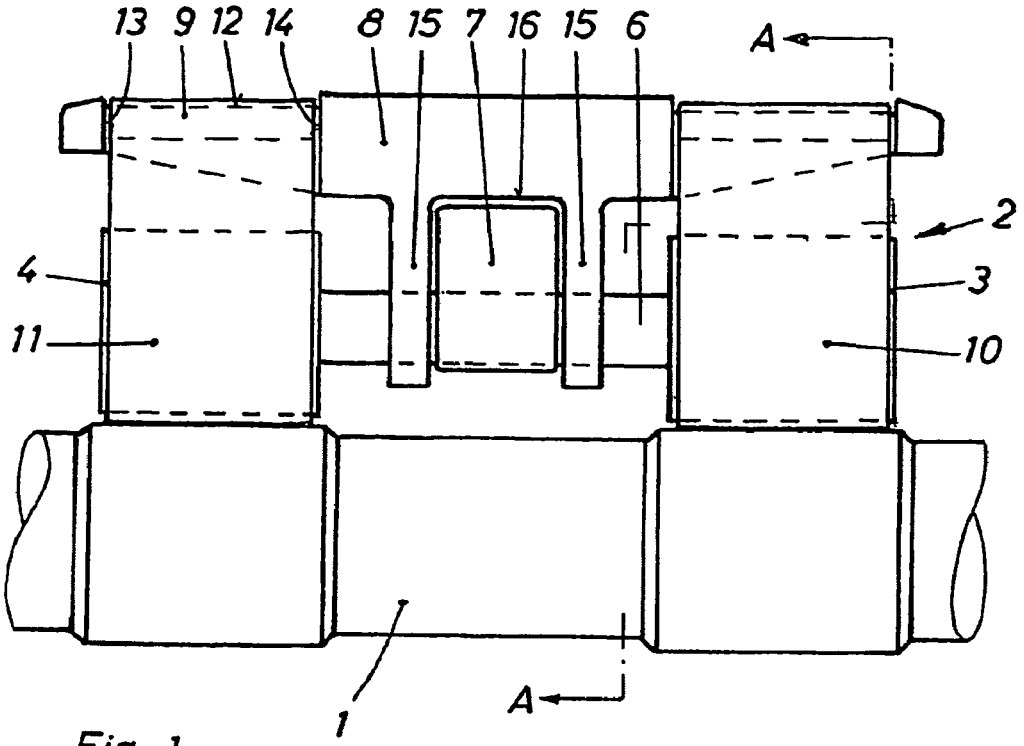
FIG. 1 shows a front view of a drafting device in a first embodiment of the invention in section in plane A-A.

Reference will now be made to embodiments of the invention, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the invention include these and other modifications and variations of the embodiments described herein.

An embodiment of the invention relates to a drafting device of a common design with a steel front bottom roller 1 running the length of the drafting machine, on which top roller pairs 2 rest, of which only one is shown here in the front view of FIG. 1. The two top rollers 3, 4 of the top roller pairs comprise a preferably soft coating 5 in order to achieve the initially described advantageous drafting conditions. They are connected by shaft 6 clipped onto spring-loaded guide rod 7. Guide rod 7 is arranged on a top roller carrying and loading arm (not shown).

One-piece holders 8 preferably manufactured from die casting are provided from which two deflection members 9 project laterally, over which aprons 10, 11 that also surround top rollers 3, 4 run. These deflection members 9 have deep deflection (i.e. "turn-around") surfaces 12 that are limited by collars 13, 14 and thus prevent the aprons from running off laterally from top rollers 3, 4 when the drafting device is running.

Figure 2:
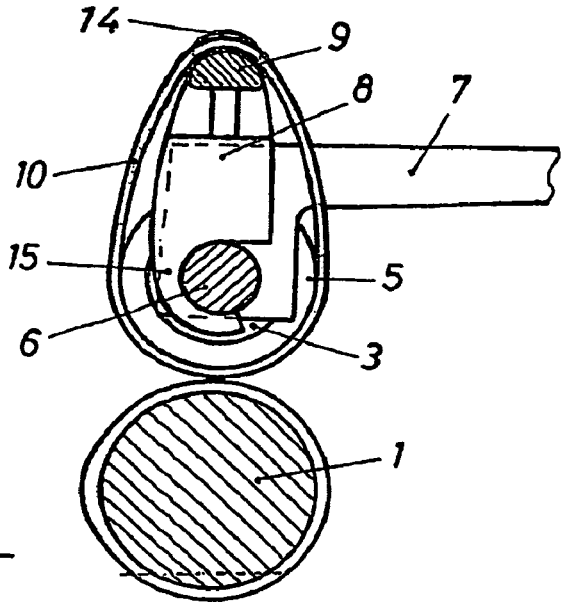
FIG. 2 shows a lateral view of the subject matter of FIG. 1.

As can be recognized from the bulging of aprons 10, 11 in FIG. 2 between top rollers 3, 4 and deflection members 9, they are placed only loosely around the deflection members and are accordingly only under the slight pressure that is caused solely by the tendency of the aprons to assume a circular form in the circumferential direction.

It is sufficient for the mode of action of the aprons striven for if they have a circumference corresponding to approximately 1½ the circumference of top rollers 3, 4. The interval "a" (FIG. 4) between the axis of rotation of the top rollers and between surfaces 12 of deflection members 9 corresponds approximately to the diameter of the top rollers. However, the circumference of the aprons can also be increased to approximately 3 times the circumference of the top rollers, or in some instances even further, in which case interval a, shown in FIG. 4, between the axis of rotation of the top rollers and surfaces 12 of deflection members 9 should be increased to at least approximately twice the diameter of the top rollers. It is understood that interval a must be in an appropriate relationship to the circumference and also to the stiffness of aprons 10, 11. In the case of rather stiff aprons interval "a" should be reduced.

Holders 8 of the embodiment of FIGS. 1, 2 comprise two holding members 15 that can be clipped onto shaft 6 of the associated top roller pair 2 and that guide the holders. Thus, a device can be readily removed from a guide rod 7 if an exchange of top rollers 3, 4 or of aprons 10, 11 is required. To this end, shaft 6 is clipped downward out of the guide rod and holding members 15 are pivoted away from the shaft to the front. When the drafting device is running, holders 8 tend to rotate clockwise with top rollers 3, 4 in the lateral view of FIG. 2. In order to prevent this, systems are provided that can be formed in the simplest form by the upper sides of guide rods 7, on which the middle range 16 of holders 8 rests.

Figure 3:
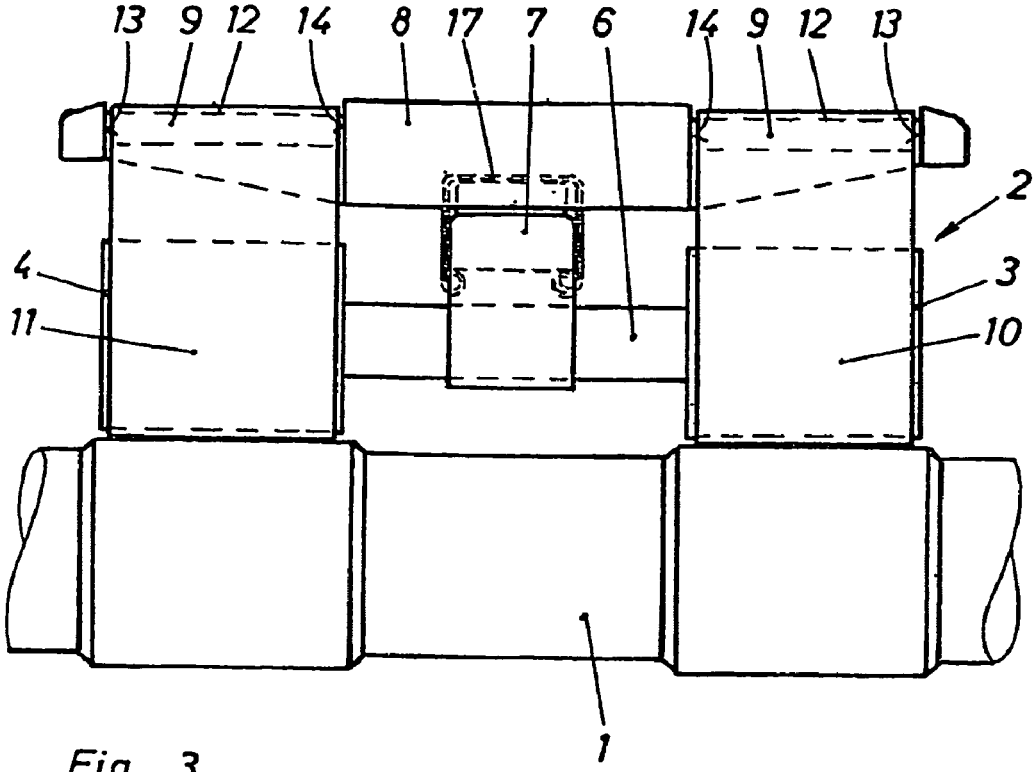
FIG. 3 shows another possibility of fastening a holder in a front view.
Figure 4:
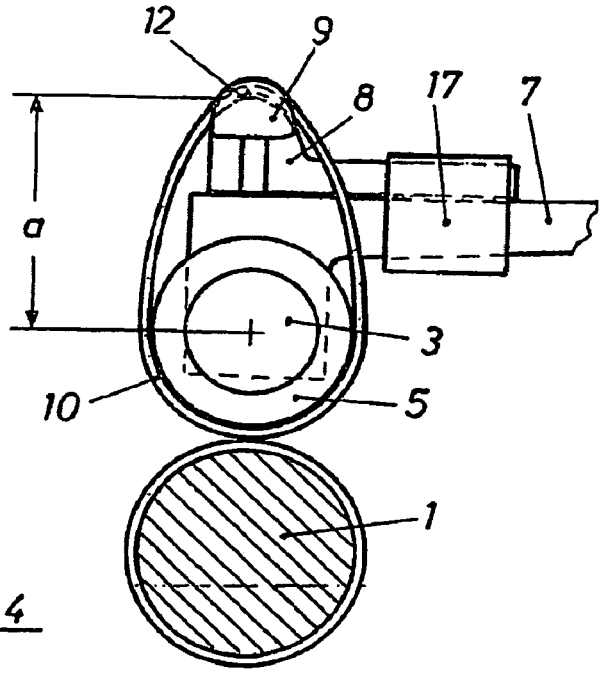
FIG. 4 shows a lateral view of the subject matter of FIG. 3.

In the embodiment of FIGS. 3, 4 holders 8 can be clipped onto guide rods 7 by resilient clamps 17 connected to the holder. In this instance, holders 8 are already held in such a manner that they rotate in unison.

As is not shown in detail, holders 8 can also be articulated to the top roller carrier and loading arms. In this instance they can be set, e.g., into the holders of the upper cleaning rollers, that are generally no longer required when using the surrounding aprons.

Aprons 10, 11 preferably consist of at least two layers of which the outer layer making contact with the fibers is adapted to the requirements of a good fiber clamping and low wear and the inner layer running over surfaces 12 of deflection members 9 is adapted to the requirement of a low-friction running.

It should be appreciated by those skilled in the art that the invention includes modifications and variations to the embodiments described herein.

The invention claimed is:

1. A drafting device for drafting fiber bundles, comprising:

a bottom roller, and twin-type delivery top rollers opposed to said bottom roller;

an apron surrounding each of said top rollers, said aprons defining a clamping surface with said bottom roller for fiber bundles, said aprons having a circumferential cross-sectional shape;

a deflection member associated with each said top front roller around which said aprons run, said deflection members formed as an integral component of a rigid holder; and wherein said deflection members are disposed away from said clamping surface at spacing interval between a deflection surface of said deflection members and an axis of said top rollers so as to establish a running path for said aprons that results in a slight deformation of said circumferential cross-sectional shape of said aprons such that said aprons bow outward in said running path between said top rollers and said deflection members and are subjected to substantially only tractive tension resulting from said aprons attempting to assume said circumferential cross-sectional shape.

2. The drafting device as in claim 1, wherein said rigid holder is detachably fastened on a structural component that supports said top rollers.

3. The drafting device as in claim 1, wherein said deflection members define recessed deflection surfaces for said aprons.

4. The drafting device as in claim 3, further comprising lateral guide members disposed at opposite sides of each of said deflection surfaces.

5. The drafting device as in claim 2, wherein said structural component comprises a shaft between said top front rollers, said rigid holder comprising a holding member that detachably fastens to said shaft.

6. The drafting device as in claim 5, wherein said rigid holder is disposed against a stationary structural component to prevent rotation of said rigid holder with rotation of said shaft.

7. The drafting device as in claim 2, wherein said structural component comprises a guide rod for said top rollers, said rigid holder fastened to said guide rod.

8. The drafting device as in claim 2, wherein said aprons have a circumferential cross-sectional shape that is between about 1 and ½ to about 3 times a circumference of said top rollers.

9. The drafting device as in claim 8, wherein said spacing interval between a deflection surface of said deflection members and an axis of said top rollers is between about 1 to about 2 times a diameter of said top rollers.

10. A method for guiding an apron in a drafting device for drafting fiber bundles, the drafting device having a bottom roller and at least one pair of top rollers, said method comprising:

guiding an apron around each of the top rollers such that the aprons define a clamping surface with the bottom roller for fiber bundles, said aprons having a circular cross-sectional shape;

defining a running path for the aprons around deflection members that results in a slight deformation of the circular cross-sectional shape of the aprons such that the aprons bow outward between the top rollers and the deflection members and are subjected to substantially only tractive tension resulting from the aprons attempting to assume their circular cross-sectional shape.

11. The method as in claim 10, further comprising defining a spacing interval between a deflection surface of the deflection member and an axis of the top front rollers to achieve the tractive tension resulting substantially only from the aprons attempting to assume their circular cross-sectional shape.

* * * * *